US007235517B2

(12) United States Patent
Smith

(10) Patent No.: US 7,235,517 B2
(45) Date of Patent: Jun. 26, 2007

(54) DEGREASING COMPOSITIONS

(75) Inventor: Richard S. Smith, West St. Paul, MN (US)

(73) Assignee: 3M Innovative Properties Company, Saint Paul, MN (US)

( * ) Notice: Subject to any disclaimer, the term of this patent is extended or adjusted under 35 U.S.C. 154(b) by 322 days.

(21) Appl. No.: 10/334,775

(22) Filed: Dec. 31, 2002

(65) Prior Publication Data

US 2004/0127380 A1 Jul. 1, 2004

(51) Int. Cl.

| | |
|---|---|
| ***C11D 1/72*** | (2006.01) |
| ***C11D 1/722*** | (2006.01) |
| ***C11D 1/90*** | (2006.01) |
| ***C11D 1/94*** | (2006.01) |
| ***C11D 3/06*** | (2006.01) |

(52) U.S. Cl. ..... 510/264; 510/245; 510/254; 510/267; 510/422; 510/499; 510/506

(58) Field of Classification Search ..... None
See application file for complete search history.

(56) References Cited

U.S. PATENT DOCUMENTS

| | | | | |
|---|---|---|---|---|
| 3,268,593 | A * | 8/1966 | Carpenter et al. | 568/616 |
| 4,105,574 | A | 8/1978 | Culmone et al. | |
| 4,117,249 | A | 9/1978 | De Simone et al. | |
| 4,302,365 | A | 11/1981 | Holmgren et al. | |
| 4,948,531 | A | 8/1990 | Fuggini et al. | |
| 5,340,488 | A | 8/1994 | Adams et al. | |
| 5,380,454 | A | 1/1995 | Griepenburg et al. | |
| 5,494,611 | A | 2/1996 | Howe | |
| 5,650,543 | A * | 7/1997 | Medina | 568/616 |
| 5,660,641 | A | 8/1997 | Howe | |
| 5,919,312 | A | 7/1999 | Wierenga et al. | |
| 5,925,195 | A | 7/1999 | King et al. | |
| 6,306,817 | B1 * | 10/2001 | Kott et al. | 510/535 |
| 6,309,425 | B1 * | 10/2001 | Murphy | 8/142 |
| 6,313,182 | B1 * | 11/2001 | Lassila et al. | 516/204 |
| 6,350,725 | B1 | 2/2002 | Levitt et al. | |
| 2002/0106589 | A1 * | 8/2002 | Rodney et al. | 430/325 |
| 2003/0087793 | A1 * | 5/2003 | Deak et al. | 510/466 |

FOREIGN PATENT DOCUMENTS

| | | | |
|---|---|---|---|
| JP | 10-219283 A | 8/1998 | |
| WO | WO99/60448 | * 11/1999 | |

* cited by examiner

*Primary Examiner*—Gregory R. Del Cotto
(74) *Attorney, Agent, or Firm*—Pamela L. Stewart

(57) ABSTRACT

Degreasing compositions that may be used, for example, to degrease substrates such as contaminated surfaces of automobile engines are disclosed. The degreasing compositions comprise a builder, an amphoteric surfactant, and an alkoxylated acetylenic diol having the structure of formula (I) or (II):

(I)

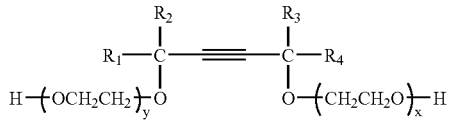

where: $R_1$ and $R_4$ are, independently, alkyl radicals containing from 3 to 10 carbon atoms;

$R_2$ and $R_3$ are, independently, selected from the group consisting of methyl and ethyl; and (x+y)=2 to 50;

(II)

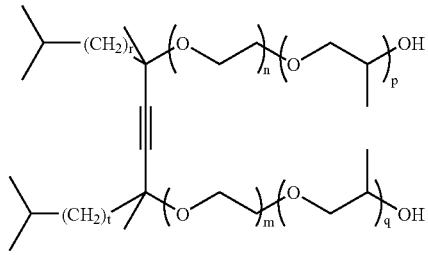

where: r and t are each, independently, 1 or 2;
(n+m)=1 to 30; and
(p+q)=1 to 30.

Certain embodiments of the degreasing composition are non-caustic, low VOC and may be low phosphate or phosphate-free.

8 Claims, No Drawings

DEGREASING COMPOSITIONS

FIELD

The present invention relates to degreasing compositions comprising alkoxylated acetylenic diols.

BACKGROUND

Vehicle exteriors accumulate road grime during use. Depending on the season, road grime may comprise bugs, tar or salt, as well as exhaust particulates, tire residues, leaking vehicle fluids and the like. The oily dirty residue within engine compartments comprises a similar mix of contaminants, but which are significantly carbonized by heat from the engine. With respect to the latter, removing this carbonized oily dirt may require a degreaser rather than a conventional cleaner.

Engine degreasers often include one or more hazardous and/or undesirable components, for example, petroleum based and/or halogenated solvents that may be classified as VOCs, highly caustic media, and/or silicates. Such aggressive degreasers have to be carefully applied to avoid damaging the vehicle's exterior.

Engine degreaser compositions may also include phosphates. While phosphates are effective sequestering agents and provide for more effective rinsing of the cleaner from the treated substrate, they are environmentally unfriendly as they promote algae and other plant growth. Consequently, municipalities are restricting or banning the use of phosphate products that may enter the watershed.

Achieving degreasing effectiveness within the constraints of low VOCs, desirable alkalinity levels and low phosphate concentration has proved difficult.

SUMMARY

The present invention provides degreasing compositions that may be used, for example, to degrease substrates such as contaminated surfaces of automobile engines.

In one aspect the present invention provides non-caustic and low VOC degreasing compositions comprising:

(a) an alkoxylated acetylenic diol of formula (I) or (II):

(I)

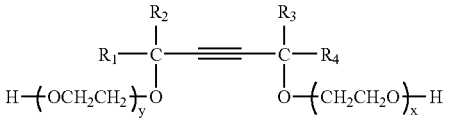

where: $R_1$ and $R_4$ are, independently, alkyl radicals containing from 3 to 10 carbon atoms, preferably $R_1$ and $R_4$ are $—CH_2CH_2CH(CH_3)_2$;

$R_2$ and $R_3$ are, independently, selected from the group consisting of methyl and ethyl; and (x+y)=2 to 50, preferably 3 to 10, and more preferably 4 to 7;

(II)

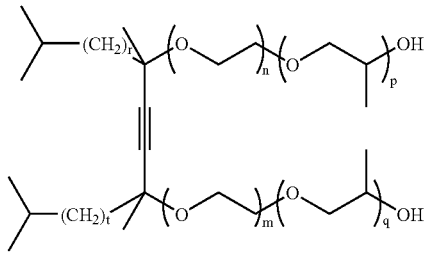

where: r and t are each, independently, 1 or 2;

(n+m)=1 to 30; and (p+q)=1 to 30;

(b) a builder; and (c) an amphoteric surfactant.

As used herein the term "low VOC" means that the degreasing composition of the present invention comprises less than about 50% by weight volatile organic compounds (VOC). As used herein the term "volatile organic compound" or "VOC" includes hydrocarbon materials having a vapor pressure equal to or greater than 0.1 mm Hg.

As used herein the term "non-caustic" means that the degreasing composition does not include strongly alkaline materials, for example, hydroxides or silicates, in particular metasilicates.

Representative examples of builders include alkali-metal phosphates, sodium metasilicate, sodium tetraborate, and sodium citrate. The builder is typically present in the degreasing composition in an amount ranging from about 0.1% to about 12% by weight of the composition.

Representative examples of amphoteric surfactant include amino proprionates, imino propionates, betaines, and sultaines. The amphoteric surfactant is typically present in the degreasing composition in an amount ranging from about 0.05% to about 10% by weight of the composition.

Some embodiments of the degreasing compositions of the invention are low phosphate or are phosphate free. As used herein the term "low-phosphate" means that the degreasing composition contains less than 1% by weight phosphate-containing materials, for example, alkali-metal phosphates. As used herein the term "phosphate-free" means that the degreasing composition does not include phosphate-containing materials, for example, alkali-metal phosphates. Phosphate-free degreasing compositions typically include a non-phosphate builder, for example, sodium citrate.

Another aspect the present invention provides phosphate-free, low VOC degreasing compositions comprising an alkoxylated acetylenic diol of formula (II):

(II)

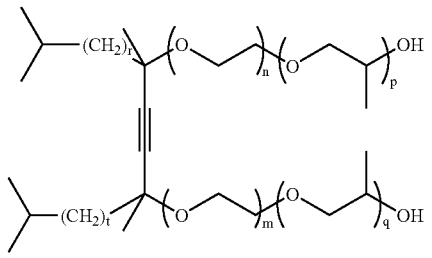

where:

r and t are each, independently, 1 or 2;

(n+m)=1 to 30; and (p+q)=1 to 30;

(b) a builder; and (c) an amphoteric surfactant.

Phosphate-free degreasing compositions may include caustic, for example, potassium hydroxide or sodium hydroxide.

DETAILED DESCRIPTION

Degreasing compositions of the present invention comprise an alkoxylated acetylenic diol, a builder, and an amphoteric surfactant. Components making up degreasing compositons of the present invention are described in detail below.

Alkoxylated Acetylenic Diols:

Compositions of the present invention comprise an alkoxylated adduct of a tertiary acetylenic diol, for example, an ethylene oxide adduct of a tertiary acetylenic diol or an ethylene oxide/propylene oxide adduct of a tertiary acetylenic diol.

Ethylene oxide adducts of tertiary acetylenic diols are described in U.S. Pat. No. 5,650,543 (Medina), the disclosure of which is incorporated herein by reference. Such adducts have the general structural formula (I):

(I)

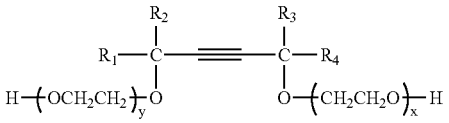

where:

$R_1$ and $R_4$ are, independently, alkyl radicals containing from 3 to 10 carbon atoms, preferably $R_1$ and $R_4$ are $—CH_2CH_2CH(CH_3)_2$;

$R_2$ and $R_3$ are, independently, selected from the group consisting of methyl and ethyl; and (x+y)=2 to 50, preferably 3 to 10, and more preferably 4 to 7.

Commercially available ethylene oxide adducts of tertiary acetylenic diols include those available under the trade designations "SURFYNOL 420", "SURFYNOL 440", "SURFYNOL 465", and SURFYNOL 485" from Air Products, Allentown Pa.

Ethylene oxide/propylene oxide adducts of acetylenic diols and described in U.S. Pat. No. 6,313,182 (Lassila et al.), the disclosure of which is incorporated herein by reference. Such adducts have the general structural formula (II).

(II)

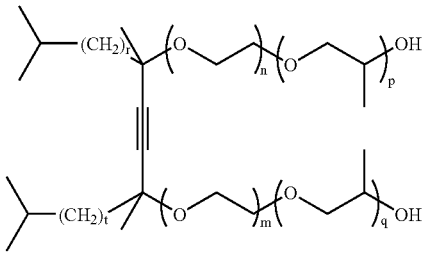

where:

r and t are independently 1 or 2;

(n+m)=1 to 30; and (p+q)=1 to 30.

The ethylene oxide and propylene oxide units may be distributed along the chain in blocks of ethylene oxide and propylene oxide or the ethylene oxide and propylene oxide units may be distributed randomly.

Preferred ethylene oxide/propylene oxide adducts of acetylenic diols include those where r=t; (n+m)=1.3 to 15 and (p+q)=1 to 10. More preferred ethylene oxide/propylene oxide adducts of acetylenic diols include those where r=t, (n+m)=1.3 to 10 and (p+q)=1 to 3.

A representative example of an acetylenic diol is commercially available under the trade designation "SURFYNOL 2502" from Air Products, Allentown Pa.

Alkoxylated acetylenic diols of the type shown in formulas (I) and (II) are typically present in compositions of the invention in an amount ranging from about 0.05% to about 10% by weight of the composition, more preferably ranging from about 0.05% to about 0.5%, and most preferably from about 0.10% to about 0.35% by weight of the composition. Compositions of the present invention may be provided in a concentrated water-dilutable composition. When provided as a dilutable composition, the alkoxylated acetylenic diol is typically present in an amount ranging from about 1% to about 10% by weight, more typically about 1% to about 6% by weight, and most typically about 2.5% to about 5% by weight of dilutable composition.

Compositions of the invention comprise a builder. A builder is a material that increases the effectiveness of the degreasing composition, for example, by acting as a softener and as a sequestering and/or buffering agent. Examples of builders include alkali-metal phosphates (e.g., sodium tripolyphosphate, potassium tripolyphosphate, sodium phosphate, sodium dihydrogen phosphate, etc). Other examples of builders include sodium metasilicate, sodium tetraborate, and sodium citrate. Builders such as as sodium citrate may be chosen in order to provide degreasing compositions that are low phosphate or are phosphate free. The builder is typically incorporated into the degreasing composition of the invention in an amount ranging from about 0.1% to about 12% by weight. When provided in a concentrated, end-user dilutable form, the builder is typically present in an amount ranging from about 3% to about 10% by weight, more preferably from about 5% to about 8% by weight. In the diluted form, the builder is typically present in an amount ranging from about 0.1% to about 2.0% by weight, more preferably about 0.2% to about 1.0% by weight. Builders are commercially available from Asteris, LLC (St. Louis, Mo.); Aldrich Chemical Co. (Milwaukee, Wis.); Ashland Chemical Co. (Columbus, Ohio), and Rhodia, Inc.(Cranbury, N.J.).

Compositions of the invention comprise an amphoteric surfactant. Representative examples of amphoteric surfactants include amino proprionates, imino propionates, betaines, sultaines, and the like. The amphoteric surfactant is incorporated in the composition in an amount ranging from about 0.05% to about 10% by weight. When provided in a concentrate, end-user dilutable form, the amphoteric surfactant is typically included in an amount ranging from about 2% to about 7% by weight, more preferably ranging from about 3% to about 6% by weight. In diluted form the amphoteric surfactant is typically present in an amount ranging from about 0.1% to about 1.0% by weight, more preferably about 0.1% to about 0.5% by weight. Amphoteric surfactants are commercially available under the trade designations "MIRITAINE JC-HA" and "MIRITAINE H2C-HA", from Rhodia, Inc., Cranbury, N.J.

Degreasing composition of the invention are low VOC. As used herein the term "low VOC" means that the degreasing composition comprise less than about 50% by weight volatile organic compounds (VOC). As used herein the term "volatile organic compound" or "VOC" includes hydrocarbon materials having a vapor pressure equal to or greater than 0.1 mm Hg. In some embodiments the degreasing composition comprises less than about 30% by weight VOC, and may comprise less than about 10% by weight VOC.

Some embodiments of the degreasing compositions of the invention are non-caustic. As used herein the term "non-caustic" means that the degreasing composition does not include strongly alkaline materials, for example, hydroxides or silicates, in particular metasilicates. In some embodiments, the degreasing compositions have a pH ranging from about 7 to about 14, more preferably ranging from about 8 to about 10, and most preferably ranging from about 8.5 to about 10.

Some embodiments of the degreasing compositions of the invention are low-phosphate or are phosphate-free. As used herein the term "low-phosphate" means that the degreasing composition contains less than 1% by weight phosphate-containing materials, for example, alkali-metal phosphates. It is understood that a concentrated end-user dilutable form of the degreasing composition may be provided having a higher level of phosphate, however, when properly diluted to its usable concentration would be low phosphate. As used herein the term "phosphate-free" means that the degreasing composition does not include phosphate-containing materials, for example, alkali-metal phosphates. Phosphate-free degreasing compositions typically include a non-phosphate builder such as sodium citrate.

In some embodiments, phosphate-free degreasing compositions of the invention include caustic, for example, potassium hydroxide, sodium hydroxide, ammonium hydroxide or sodium metasilicate. In some embodiments the caustic is included in an amount ranging from about 0.2% to about 0.5% by weight of the degreasing composition. If the degreasing composition is supplied in a concentrated, end-user dilutable form, caustic is typically present in an amount ranging from about 3% to 6% by weight. Preferred alkoxylated acetylenic diols for phosphate-free degreasing compositions that include caustic are ethylene oxide/propylene oxide adducts of acetylenic diols shown in formula (II).

Compositions of the invention may optionally comprise an anionic, cationic or a nonionic surfactant. Representative examples of nonionic surfactants include, for example, primary alcohol ethoxylates series, commercially available under the trade designation "TOMADOL", for example, "TOMADOL 1–9" from Tomah[3] Products, Inc. (Milton Wis.); secondary alcohol ethoxylates series, commercially available under the trade designation "TERGITOL" from Dow Chemical Company (Midland Mich.); and nonylphenol ethoxylates series, commercially available under the trade designation "TRITON", for example, TRITON X-100" from Dow Chemical Co. (Midland Mich.). The anionic, cationic or nonionic surfactant is typically present in an amount ranging from 0 to about 5% by weight of the composition.

Compositions of the present invention may optionally comprise a fragrance. Typically, a fragrance is incorporated in an amount ranging from 0 to about 1% by weight of the composition, although amounts outside of this range may also be suitable in some instances. A suitable fragrance is commercially available under the trade designation "FRAGRANCE #38458" from Bell-Aire Fragrances, Mundelein, Ill.

Compositions of the present invention may optionally comprise a biocide or preservative to prolong the useful life of the composition, for example, by killing or inhibiting the growth of microorganisms such as bacteria, molds, slime, fungi, and the like. A biocide or preservative is typically present in an amount ranging from 0 to 0.2% by weight of the composition.

Compositions of the present invention may optionally comprise a dye or colorant. A dye or colorant is added, for example, to add visual appeal to the composition and/or to allow the end-user to visually estimate the concentration of the composition. Suitable dyes or colorants are water-soluble and provide a desirable color. Typically, a dye or colorant is added in an amount ranging from about 0.001 to 0.1% by weight although amounts outside of this range may also be suitable.

Compositions of the present invention may be prepared by mixing the required components in any suitable mixing container. Preferably the builder is dissolved first at ambient temperature, i.e., about 20° C. The mixing time will depend on the rate of agitation and the concentration of the composition, but is typically between 10 and 30 minutes. Remaining components are dissolved sequentially, typically requiring between 5 and 10 minutes between additions. Preferably the ethoxylated or ethoxylated/propoxylated acetylenic diols of the present invention are added last and mixing continued until a homogenous solution is obtained.

In use, compositions of the present invention are typically applied to a soiled substrate using a liquid spraying device, for example, a garden sprayer, trigger spray bottle or a pressure spray washer. After applying the degreasing composition, the composition is allowed to act on the soil for a period of about 1 minute or more. Multiple applications of the degreasing composition may be desirable for heavily soiled substrates. After allowing the composition to act on the soiled substrate, the degreasing composition is then removed from the substrate using a pressurized stream of water, for example, a garden hose equipped with a nozzle or a pressure washer.

EXAMPLES

The examples are merely for illustrative purposes only and are not meant to be limiting on the scope of the appended claims. All parts, percentages, ratios, etc. in the examples and the rest of the specification are by weight unless indicated otherwise. Unless otherwise noted, all reagents used in the examples were obtained, or are available from, general chemical suppliers such as Aldrich Chemical Co., Milwaukee, Wis., or may be synthesized by known methods.

The following abbreviations are used in the examples:

"JCHA" refers to an amphoteric surfactant, having the trade designation "MIRITAINE JC-HA", from Rhodia, Inc., Cranbury, N.J.

"HCHA" refers to an amphoteric surfactant, having the trade designation "MIRITAINE H2C-HA", from Rhodia, Inc.

"S-61" refers to an acetylenic alcohol, having the trade designation "SURFYNOL 61", from Air Products, Allentown, Pa.

"S-104" refers to an acetylenic diol, having the trade designation "SURFYNOL 104", from Air Products.

"S-420" refers to an acetylenic diol-ethylene oxide adduct, having the trade designation "SURFYNOL 420", from Air Products.

"S-440" refers to an acetylenic diol-ethylene oxide adduct, having the trade designation "SURFYNOL 440", from Air Products.

"S-465" refers to an acetylenic diol-ethylene oxide adduct, having the trade designation "SURFYNOL 465", from Air Products.

"S-2502" refers to an acetylenic diol-ethylene oxide/propylene oxide adduct, having the trade designation "SURFYNOL 2502", from Air Products.

"SCD" refers to sodium citrate dihydrate, technical grade, from Aldrich Chemical Co., Milwaukee, Wis.

"STTP" refers to sodium tripolyphosphate, technical grade, from Aldrich Chemical Co.

"T1–9" refers to, a secondary alkyl ethoxylate nonionic surfactant having the trade designation "TOMADOL 1–9", from Tomah Reserve, Tomah, Wis.

"TX-100" refers to a nonylphenol ethoxylate nonionic surfactant, having the trade designation "TRITON X-100", from Dow Chemical Co., Midland, Mich.

"F-38458" refers to "FRAGRANCE #38458", from Bell-Aire Fragrances, Mundelein, Ill.

Test Procedures

With the exception of Examples 11–13 and Comparatives G–H, one solution was sprayed on the driver's side of the engine and front bumper until evenly coated. Simultaneously, another solution was evenly applied to the engine and front bumper on the passenger side of the vehicle. The relative degree of grease and dirt contamination on the vehicle prior to cleaning was rated as follows:

| Rating | Contamination Level |
|---|---|
| 3 | Extremely soiled |
| 2 | Heavily soiled |
| 1 | Moderately soiled |

After a residence time of 3 minutes the entire engine and entire bumper were thoroughly rinsed with a pressure washer having the trade designation "RHINO", available from Hot Z Distributors, Roseville, Minn., at a pressure of 2,500 psi (17.2 MPa) for 2 minutes. The vehicle was allowed to dry and the amount of dirt/grease removed was visually estimated based on the following scale:

| Rating | Amount of Dirt/Grease Removed |
|---|---|
| 6 | 100% |
| 5 | 90–95% |
| 4 | 80–90% |
| 3 | 60–80% |
| 2 | 35–60% |
| 1 | 10–35% |
| 0 | less than 10% |

Examples 1–5 & Comparatives A–E

Aqueous solutions were prepared by dissolving, in sequential order, the components listed in TABLE 1 at a temperature of 70° F. (21° C.).

TABLE 1

| COMPONENTS | Ex. 1 | Comp. A | Comp. B | Ex. 2 | Comp. C | Ex. 3 | Ex. 4 | Comp. D | Comp. E | Ex. 5 |
|---|---|---|---|---|---|---|---|---|---|---|
| Deionized Water | 98.12 | 98.12 | 98.12 | 98.80 | 98.47 | 99.01 | 99.01 | 98.47 | 98.47 | 99.13 |
| STTP | 0.54 | 0.54 | 0.54 | 0.35 | 0.44 | 0.29 | 0.29 | 0.44 | 0.44 | 0.25 |
| JCHA | 0.38 | 0.38 | 0.38 | 0.22 | 0.31 | 0.18 | 0.18 | 0.31 | 0.31 | 0.16 |
| HCHA | 0.38 | 0.38 | 0.38 | 0.22 | 0.31 | 0.18 | 0.18 | 0.31 | 0.31 | 0.16 |
| TX-100 | 0.31 | 0.31 | 0 | 0 | 0 | 0 | 0 | 0 | 0 | 0 |
| T1-9 | 0 | 0 | 0.31 | 0.17 | 0.25 | 0.14 | 0.14 | 0.25 | 0.25 | 0.13 |
| S-61 | 0 | 0.19 | 0.19 | 0 | 0.16 | 0 | 0 | 0.16 | 0.16 | 0 |
| S-2502 | 0.19 | 0 | 0 | 0.20 | 0 | 0.16 | 0.16 | 0 | 0 | 0.14 |
| F-38458 | 0.08 | 0.08 | 0.08 | 0.08 | 0.06 | 0.04 | 0.04 | 0.06 | 0.06 | 0.03 |

The following vehicles were cleaned and evaluated as described above. Results are listed in TABLE 2.

TABLE 2

| | Ex. 1 | Comp. A | Comp. B | Ex. 2 | Comp. C | Ex. 3 | Ex. 4 | Comp. D | Comp. E | Ex. 5 |
|---|---|---|---|---|---|---|---|---|---|---|
| VEHICLE | Pontiac Grand Am | | Ford Taurus | | Ford Taurus | | Dodge Caravan | | Ford Taurus | |
| KILOMETERS | 168,000 | | 104,000 | | 81,600 | | 97,600 | | 102,400 | |
| CONTAMINATION RATING | 3 | | 1 | | 1 | | 3 | | 1 | |
| DEGREASING RATING | 5 | 3 | 4 | 5 | 4 | 5 | 5 | 3 | 4 | 4 |

Examples 6–14 & Comparative F

Aqueous solutions were prepared by dissolving, in sequential order, the components listed in TABLE 3, according to the conditions outlined in Examples 1–5.

TABLE 3

| COMPONENTS | Ex. 6 | Ex. 7 | Ex. 8 | Ex. 9 | Ex. 10 | Ex. 11 | Ex. 12 | Ex. 13 | Ex. 14 | Comp. F |
|---|---|---|---|---|---|---|---|---|---|---|
| Deionized Water | 98.50 | 98.50 | 99.29 | 99.29 | 99.03 | 99.03 | 99.06 | 99.06 | 99.02 | 98.47 |
| STTP | 0.44 | 0.44 | 0.19 | 0.19 | 0.27 | 0.27 | 0.27 | 0.27 | 0.27 | 0.44 |
| JCHA | 0.31 | 0.31 | 0.14 | 0.14 | 0.19 | 0.19 | 0.19 | 0.19 | 0.19 | 0.31 |
| HCHA | 0.31 | 0.31 | 0.14 | 0.14 | 0.19 | 0.19 | 0.19 | 0.19 | 0.19 | 0.31 |
| T1-9 | 0.25 | 0.25 | 0.11 | 0.11 | 0.15 | 0.15 | 0.15 | 0.15 | 0.15 | 0.25 |
| S-61 | 0 | 0 | 0 | 0 | 0 | 0 | 0 | 0 | 0 | 0.16 |
| S-440 | 0 | 0.16 | 0 | 0.11 | 0 | 0.15 | 0 | 0 | 0.15 | 0 |
| S-465 | 0 | 0 | 0.11 | 0 | 0.15 | 0 | 0.11 | 0.11 | 0 | 0 |
| S-2502 | 0.16 | 0 | 0 | 0 | 0 | 0 | 0 | 0 | 0 | 0 |
| F-38458 | 0.03 | 0.03 | 0.02 | 0.02 | 0.02 | 0.02 | 0.03 | 0.03 | 0.03 | 0.06 |

The following vehicles were cleaned and evaluated as described above. Results are listed in TABLE 4.

TABLE 4

| | Ex. 6 | Ex. 7 | Ex. 8 | Ex. 9 | Ex. 10 | Ex. 11 | Ex. 12 | Ex. 13 | Ex. 14 | Comp. F |
|---|---|---|---|---|---|---|---|---|---|---|
| VEHICLE | Pontiac Bonneville | | Plymouth LHS | | Mercury Sable | | Toyota Camry | | Ford Crown Victoria | |
| KILOMETERS | 102,400 | | 123,200 | | 160,00 | | 192,000 | | 272,000 | |
| CONTAMINATION RATING | 3 | | 1 | | 1 | | 2 | | 3 | |
| DEGREASING RATING | 3 | 5 | 5 | 5 | 5 | 5 | 4 | 5 | 4 | 3 |

Examples 15–16 & Comparative G

Aqueous solutions were prepared by dissolving, in sequential order, the components listed in TABLE 5, according to the conditions outlined in Examples 1–5.

TABLE 5

| COMPONENTS | Comp. G | Ex. 15 | Ex. 16 |
|---|---|---|---|
| Deionized Water | 99.02 | 99.02 | 99.02 |
| STTP | 0.27 | 0.27 | 0.27 |
| JCHA | 0.19 | 0.19 | 0.19 |
| HCHA | 0.19 | 0.19 | 0.19 |
| T1-9 | 0.15 | 0.15 | 0.15 |
| S-104 | 0.15 | 0 | 0 |

TABLE 5-continued

| COMPONENTS | Comp. G | Ex. 15 | Ex. 16 |
|---|---|---|---|
| S-420 | 0 | 0.15 | 0 |
| S-440 | 0 | 0 | 0.15 |
| F-38458 | 0.03 | 0.03 | 0.03 |

Each solution was applied to discrete, equally soiled (contamination rating=2), areas of the engine of a Chevrolet Yukon (160,000 kilometers). The solutions were given a residence time of 3 minutes, after which the test areas were power washed according to the procedure described above. Results are listed in TABLE 6.

TABLE 6

| | Comp. G | Ex. 15 | Ex. 16 |
|---|---|---|---|
| Degreasing Rating | 4 | 4 | 5 |

Example 17 & Comparative H

Aqueous solutions were prepared by dissolving, in sequential order, the components listed in TABLE 7, according to the conditions outlined in Examples 1–5.

TABLE 7

| COMPONENTS | Comp. H | Ex. 17 |
|---|---|---|
| Deionized Water | 75.8 | 74.3 |
| STTP | 7.0 | 7.0 |
| JCHA | 5.0 | 5.0 |
| HCHA | 5.0 | 5.0 |
| T1-9 | 4.0 | 4.0 |
| S-61 | 2.5 | 0 |
| S-440 | 0 | 4.0 |
| F-38458 | 0.7 | 0.7 |

Each solution was diluted 1 part to 25 parts deionized water. Subsequent to the previous test on the Cheverolet Yukon, Example 17 was applied to the driver's side of the same engine. Comparative H was applied to the passenger side of the engine. The solutions were given a residence time of 3 minutes, after which the test areas were power washed according to the procedure described above. Results are listed in TABLE 8.

TABLE 8

| | Comp. H | Ex. 17 |
|---|---|---|
| Degreasing Rating | 2 | 5 |

Examples 18–19

Aqueous solutions were prepared by dissolving, in sequential order, the components listed in TABLE 9, according to the conditions outlined in Examples 1–5.

TABLE 9

| COMPONENTS | Ex. 18 | Ex. 19 |
|---|---|---|
| Deionized Water | 97.8 | 97.8 |
| KOH | 0.31 | 0.31 |
| SCD | 0.46 | 0.46 |
| JCHA | 0.38 | 0.38 |
| HCHA | 0.38 | 0.38 |
| T1-9 | 0.31 | 0.31 |
| S-2502 | 0.31 | 0 |
| S-440 | 0 | 0.31 |
| F-38458 | 0.05 | 0.05 |

Example 18 was applied to the driver's side of a Toyota Celica engine (kilometers=160,000; contamination rating=2). Example 19 was applied to the passenger side of the engine. The solutions were given a residence time of 3 minutes, after which the test areas were power washed according to the procedure described above. Results are listed in TABLE 10.

TABLE 10

| | Ex. 18 | Ex. 19 |
|---|---|---|
| Degreasing Rating | 4 | 2 |

What is claimed is:

1. An aqueous degreasing composition consisting of:

(a) alkoxylated acetylenic diol having the structure of formula (II):

(II)

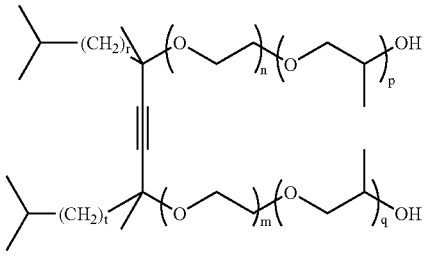

where: r and t are each, independently, 1 or 2;

(n+m)=1 to 30; and (p+q)=1 to 30;

(b) a builder selected from the group consisting of alkali-metal phosphates, sodium tetraborate, and sodium citrate; and (c) an amphoteric surfactant.

2. The degreasing composition of claim 1, wherein (n+m) =1.3 to 10 and (p+q)=1 to 3.

3. The degreasing composition of claim 1, wherein the composition is phosphate-free.

4. The degreasing composition of claim 1, wherein the alkoxylated acetylenic diol is present in an amount from about 0.05% to about 10% by weight of the composition.

5. The degreasing composition of claim 1, wherein the amphoteric surfactant is selected from the group consisting of amino proprionates, imino propionates, betaines, and sultaines.

6. The degreasing composition of claim 1, wherein the amphoteric surfactant is present in an amount from about 0.05% to about 10% by weight of the composition.

7. The degreasing composition of claim 1, wherein the composition has a pH ranging from about 7 to about 14.

8. The degreasing composition of claim 1, wherein the composition is low phosphate.

* * * * *

UNITED STATES PATENT AND TRADEMARK OFFICE

CERTIFICATE OF CORRECTION

PATENT NO. : 7,235,517 B2
APPLICATION NO. : 10/334775
DATED : June 26, 2007
INVENTOR(S) : Richard S. Smith It is certified that error appears in the above-identified patent and that said Letters Patent is hereby corrected as shown below:

Column 3
Line 19, Delete "compositons" and insert --compositions--, therefor.
Line 60, before "SURFYNOL" insert --"--.
Line 67, delete "(II)." and insert --(II):--, therefor.

Signed and Sealed this

Twenty-fifth Day of March, 2008

JON W. DUDAS
*Director of the United States Patent and Trademark Office*